US005154455A

United States Patent [19]

Awalt, Jr.

[11] Patent Number: 5,154,455

[45] Date of Patent: Oct. 13, 1992

[54] DEADBOLT LOCK HAVING A U-SHAPED SQUEEZE OPERATED SLIDING BOLT

[76] Inventor: Thomas Y. Awalt, Jr., 1600 Siguenza Dr., Pensacola, Fla. 32507

[21] Appl. No.: 793,192

[22] Filed: Nov. 18, 1991

[51] Int. Cl.[5] ..... E05C 3/14

[52] U.S. Cl. ..... 292/42; 292/262; 292/278; 292/147

[58] Field of Search ..... 292/42, 10, 152, 246, 292/247, 250, 262, 278, 147; 24/68 T

[56] References Cited

U.S. PATENT DOCUMENTS

| | | | |
|---|---|---|---|
| 1,097,657 | 5/1914 | Malick | 292/258 |
| 1,513,308 | 10/1924 | Berry | 292/147 |
| 3,226,961 | 1/1966 | Jacobs | 292/91 |

FOREIGN PATENT DOCUMENTS

| | | | |
|---|---|---|---|
| 398457 | 7/1924 | Fed. Rep. of Germany | 292/147 |
| 410220 | 2/1925 | Fed. Rep. of Germany | 292/147 |
| 640096 | 12/1936 | Fed. Rep. of Germany | 292/147 |
| 2752006 | 5/1979 | Fed. Rep. of Germany | 292/246 |

*Primary Examiner*—Eric K. Nicholson

[57] ABSTRACT

An improved deadbolt doorlock bolt assembly has a squeeze-operated "U"-shaped bolt in a channel and may be combined with a receiver assembly. The lock may include an elongated guard with an elongated hook, the guard being hinge mounted on either assembly. When the guard is set, it limits opening of the door to just enough for identification purposes.

8 Claims, 2 Drawing Sheets

DEADBOLT LOCK HAVING A U-SHAPED SQUEEZE OPERATED SLIDING BOLT

SUMMARY OF THE INVENTION

This invention relates to external deadbolt locks, particularly door locks, and to combinations of external deadbolt locks with guards which permit the limited opening of a door for identification purposes.

BACKGROUND OF THE INVENTION

A. The Prior Art

Most prior art deadbolt door locking devices are either external (in the sense that they are mounted on the inside of, but external to the door) or internal (in the sense that they are mounted within the door. Because internal locks are tunnelled into wooden doors, thereby weakening the lock by as much as 75%, external deadbolt locks serve a very important function as secondary reinforcing locks. Moreover, since many internal deadbolt locks can be opened from the outside by key, external deadbolt locks are also used to prevent access by lock picking or in places where keys may not be strictly controlled.

When external deadbolts are so used as the ultimate security measure it is especially important that they are simple to operate and easily and safely coordinated with identification guards, even by those who may be incapacitated, ill or half asleep. Prior art chain guards, besides being cumbersome and dangerous to operate, hazarding the fingers of children cannot be easily coordinated with a lock. Bracket type guards present the same problem. To use one with the other may take some skill, concentration, or even more than two hands. For example, to use a conventional chain guard in conjunction with a conventional deadbolt lock, one must unhang, then rehang the end of the chain; then retract the deadbolt (one or two movements); then turn the door knob and crack the door)—six movements all in proper sequence.

It would therefore be an advance in the art if an effective deadbolt lock were so combined with a guard that only two movements were required (one with each hand) to safely crack the door.

It is therefore an object of this invention to provide a deadbolt lock/guard combination which minimizes the movements and coordination required to safely crack the door.

It is another object of this invention to provide an external deadbolt lock with improved co-planar stability which is especially useful with double doors.

It is yet another object of this invention to provide an external deadbolt lock which is virtually tamperproof with wire.

B. Brief Description of the Invention

These and other objects are accomplished in a guarded deadbolt lock comprising in combination a sliding bolt assembly with an essentially U-shaped sliding bolt, the bend and contiguous portion being the lock engagement portion, and the ends and contiguous portion being the squeeze-type handle portion. The bolt slides in a channel which has a channel closure means to hold the bolt in the channel and mounting means for the channel.

Juxtaposed with the bolt assembly is a channel shaped receiver assembly for receiving the bolt, which also has closure means and mounting means.

Hinge-mounted on either assembly is an elongated guard with an elongated hook. This hook fits over and engages the channel closure means of the other assembly (preferably with a point of resistance to prevent accidental disengagement), in one position, and in a second position lies disengaged but preferably retained in the channel in which mounted, the guard fitting easily between the legs of the sliding bolt as necessary to assume either of these positions.

In the detailed description, reference will be made to the Drawings in which.

DETAILED DESCRIPTION OF THE INVENTION

By "guard" is meant any device which permits a door, hatch or other closure to be opened slightly to permit viewing and the passage of identification means, but to prevent further opening from the outside.

By "guarded" is meant equipped with a guard or in a position in which a guard is in effect.

By "channel closure means" is meant any feature on the sides or opening of a channel which fully or partly closes the channel opening for any purpose including bolt retention, mounting the guard or engagement of the hook arm of the guard.

By "bolt retention" is meant maintaining the bolt within the channel as against lateral forces.

Figure 1:
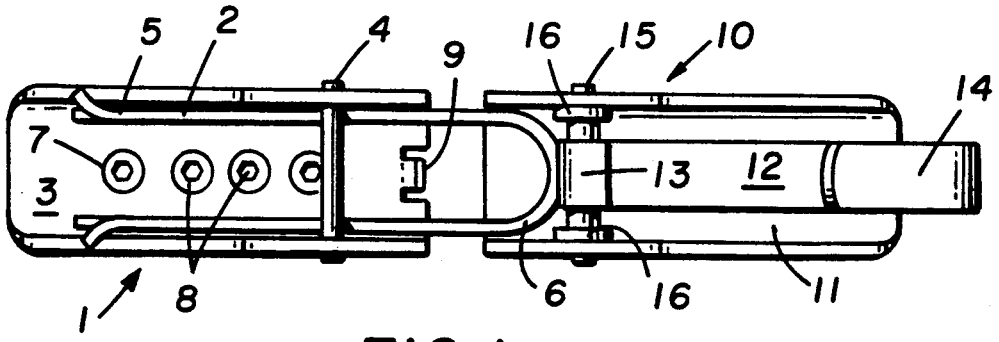
FIG. 1 is an overhead view of a first preferred embodiment of this invention, in the locked but unguarded position.
Figure 2:
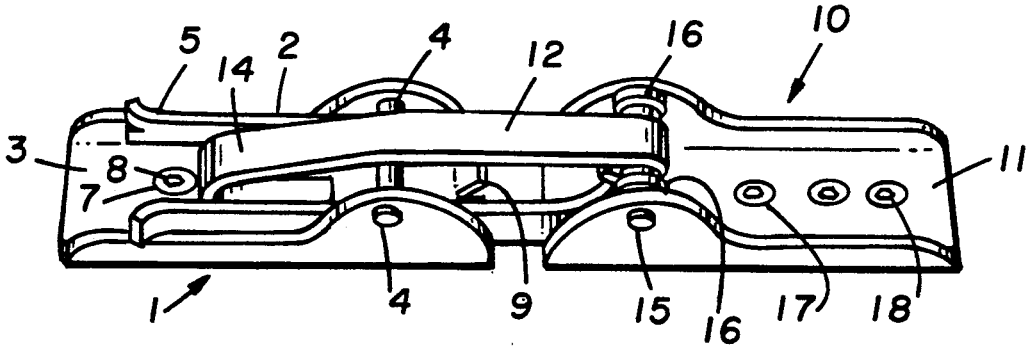
FIG. 2 is a perspective view of the same embodiment in the locked and guarded position.

Referring now to FIGS. 1 and 2, bolt assembly 1 comprises bolt 2, channel 3 and pin 4 which closes channel 3 and retains bolt 2. Bolt 2 comprises handle portion 5 and lock engagement portion 6. On the base of channel 3 are mounting holes 7 holding screws 8. On the leading edge of channel 3 is bolt stop 9. Juxtaposed with bolt assembly 1 is receiver assembly 10 comprising channel 11 carrying pin 15 with hinge-mounted guard 12 on hinge 13 having elongated hook 14. Hinge 13 is centered by spacers 16. Seen only on FIG. 2 are mounting holes 17 and screws 18.

Figure 3:
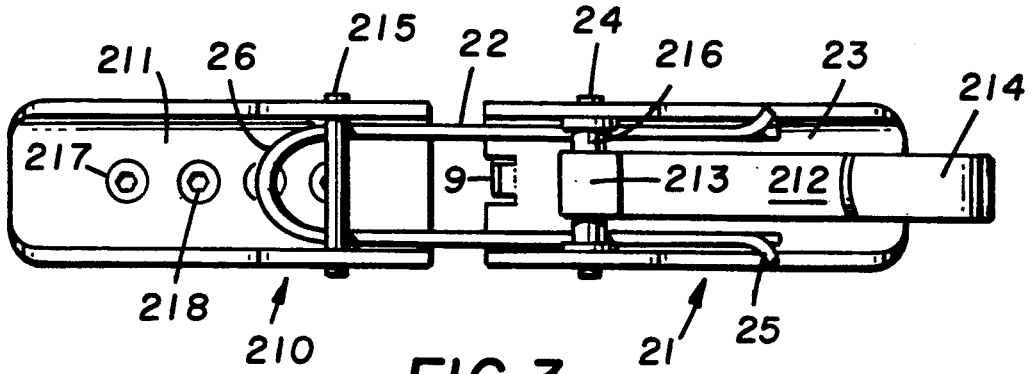
FIG. 3 is an overhead view of a second preferred embodiment of this invention in the locked but unguarded position.
Figure 4:
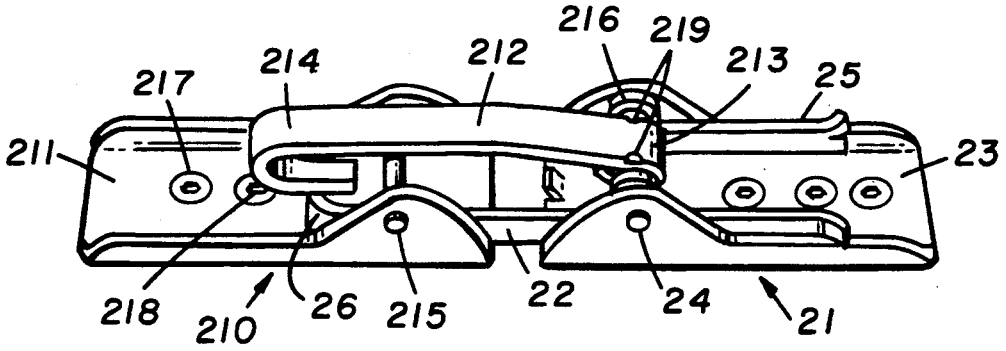
FIG. 4 is a perspective view of the embodiment of FIG. 3 in the locked guarded position and FIG. 5 is a plan view of the embodiment of FIG. 3 on the guarded open position.
Figure 5:
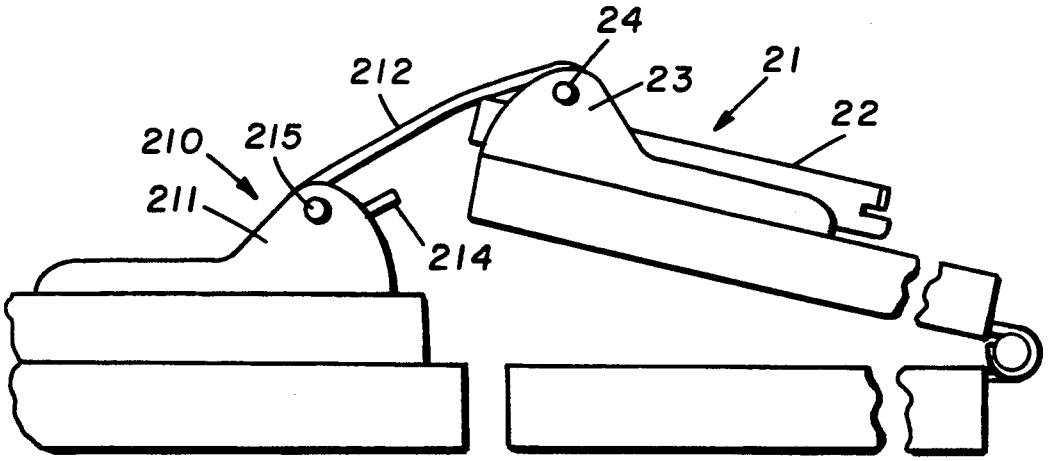

Referring to FIGS. 3–5, bolt assembly 21 comprises bolt 22, channel 23 and pin 24. Bolt 22 comprises handle portion 25 and lock engagement portion 26. Pin 24 closes channel 23 and retains bolt 22. It also carries hinge-mounted guard 212 on hinge 213 having elongated hook 214 and retention notches 219. Juxtaposed with bolt assembly 21 is receiver assembly 210 comprising channel 211 and carrying pin 215. Channel 211 has mounting holes 217 and screws 218.

In the operation of the embodiment of FIGS. 1 and 2, bolt 2 is extended to lock and retracted to unlock by squeezing slightly handle portions 5 at the same time exerting a force toward or away from the receiver assembly. Guard 12 is flipped into the guarded position across a resistance imposed by the end of elongated hook 14 as it passes pin 4. When the guard is in the guarded position, the lock can be retracted and the door can be cracked for identification. It can also be returned to the guarded lock position simply by closing the door and extending bolt 2.

In the operation of the embodiment of FIGS. 3-5, bolt 22 is extended to lock and retracted to unlock by squeezing slightly handle portions 25, at the same time exerting a force toward or away from receiver assembly 210. Like the embodiment of FIGS. 1 and 2, guard 212 is flipped into a guarded position across a resistance imposed by the end of elongated hook 214 as it passes pin 215, but in the opposite direction from that of FIG. 1 and 2. In this embodiment, however, if the bolt is in the extended lock position shown in FIG. 3, elongated hook 214 will come to rest against lock engagement portion 26 of bolt 22, as shown in FIG. 4, from which elongated hook 214 will descend into channel 211 when bolt 22 is manually retracted and the door opened in the guarded position. Guard 212 is disengaged by flipping elongated hook 214 back across pin 215 to lie in channel 23. Bolt 22 may then be fully retracted causing retention notches 219 (see FIG. 4) to engage lock engagement portion 26 of bolt 22.

The configuration of the sides of the channels of the bolt assembly must be such as to permit hand and/or finger access to the handle portion of the bolt. If the channel extends to the operating range of handle portion of the bolt, the upper sides of the channel are preferrably cut away to permit access to the handle portion of the bolt, without entirely sacrificing the strength and guiding effect of the lower portion of the sides of the channel.

The essentially U-shaped bolt is preferably fabricated of a flexible material and shaped to slide in the channel of the bolt assembly with a slight squeeze easily imposed between, and accessable to the thumb and forefinger. Preferably the unchanneled (outer portion) of the bitter ends of the handle portions of the bolt are flared to prevent the fingers from slipping off when retracting the bolt, a feature which also prevents removal of the bolt.

It will be noted that the shape of the bolt as described herein is virtually without tamperable protrusions which could be used to retract the bolt with a wire inserted around or through the door. Such protrusions are preferably avoided.

Although pins are used in the preferred embodiments for bolt retention, bolt engagement, guard mounting and guard engagement, most of the same results can be obtained with the use of a full or partially bent, molded or capped channel closures in any one of various shapes or combinations thereof which perform the same function. A simple form of channel closure for bolt retention, for example, is a lip on the open sides of the channel bent inwardly. Moreover, while most of the channel closure pins in the preferred embodiments serve dual functions, such dual function, while preferable, is not essential to the generic invention claimed. For example, however desirable and inventive, there is no requirement that the same pin or other structure serve both as a bolt retainer and a guard mount as in the embodiment of FIGS. 3-5.

The elongated guard is necessarily shaped to prevent jamming the engaged channel closure means (pin) and the floor of the channel in which the closure means (pin) is mounted when the door is opened in the guarded mode. It is preferably shaped to provideany necessary clearance of the guard over the bend of the bolt (FIG. 3-5) or the leading edge of the channel (FIG. 1-2) on which the guard is hinge-mounted, and thereby permit the elongated hook to ride on the channel closure means (pin)mof the opposing assembly as closely as possible to the end of the guard. Accordingly a preferred guard has a shallow closing bend ($\pm 170°$) at about $\frac{1}{3}$ the distance between the hinge mounting and the opposite end of the guard.

I claim:

1. A deadbolt doorlock having a bolt assembly consisting essentially of, in combination (1) an essentially "U"-shaped sliding bolt having two legs and a bend with a handle portion on the legs and a lock engagement portion at and contiguous to the bend, and (2) slidable mounting means for the sliding bolt comprising a channel and channel closure means for retaining the sliding bolt in the channel and providing retracted and extended bolt positions for unlocking and locking the door and mounting means for the channel, the channel having sides shaped to permit operator access to the handle portion of the bolt.

2. The deadbolt lock of claim 1, further including a receiver assembly for receiving the bolt in the extended position comprising a channel having a base with receiver assembly mounting means and receiver assembly channel closure means including bolt retention means.

3. A deadbolt doorlock having a bolt assembly comprising in combination (1) an essentially "U"-shaped sliding bolt having two legs and a bend with a handle portion on the legs and a lock engagement portion at and contiguous to the bend, and (2) slidable mounting means for the sliding bolt comprising a channel and channel closure means for retaining the sliding bolt in the channel and providing retracted and extended bolt positions for locking and unlocking the door and mounting means for the channel, the channel having sides shaped to permit operator access to the handle portion of the bolt; the lock further including a receiver assembly for receiving the bolt in the extended position comprising a channel having a base with receiver assembly mounting means and receiver assembly channel closure means; an elongated guard having hinged mounting means on one end and an elongated hook on the other, the hinged mounting means being mounted on one of said assemblies, the elongated hook being so shaped, when the bolt assembly is juxtaposed with the receiver assembly, to rotate over and engage the channel closure means of the other assembly thereby placing the lock in a guarded mode, and alternatively to rotate back and to an unengaged position thereby leaving the lock in an unguarded mode, said rotation being at least partially between the legs of the bolt, whereby the elongated guard may be engaged and disengaged essentially independent of the bolt position, and in the guarded position, limits opening of the door.

4. The guarded deadbolt lock of claim 3 wherein the mounting means for the elongated guard and the receiver assembly channel closure means is a single receiver assembly pin, where the bolt assembly closure means is a bolt assembly pin, and where, going into the guarded position, the elongated hook fits over and engages the bolt assembly pin.

5. The guarded deadbolt lock of claim 3 wherein the mounting means for the elongated guard and the bolt assembly channel closure means is a single bolt assembly pin, where the receiver assembly closure means is a receiver pin, and where going into the guarded position, the elongated hook fits over and engages the receiver pin.

6. The guarded deadbolt lock of claim 3 wherein the assemblies are so mounted in juxtaposition that when the elongated hook goes into the guarded position by fitting over and engaging a channel closure means, it passes a resistance position which prevents an accidental disengagement of the elongated hook with the channel closure means.

7. The guarded deadbolt lock of claim 3 wherein the configuration of the bolt and guard is such that, with the sliding bolt assemble in the fully locked position, when the elongated hook is fitted over and engaged with the channel closure means, it comes to rest against the top of the bolt, thereby providing a half guard position which jumps into a full guard position when the bolt is retracted for unlocking.

8. The guarded deadbolt lock of claim 3 further including retainer means for holding the elongated guard in one of said channels when unengaged in the unguarded mode when the bolt is in the retracted position.

* * * * *